US012790826B2

(12) United States Patent
Lee et al.

(10) Patent No.: US 12,790,826 B2
(45) Date of Patent: Nov. 10, 2026

(54) MODULE FOR STAIRCASE AND STAIRCASE SYSTEM INCLUDING SAME

(71) Applicants: Hyundai Motor Company, Seoul (KR); Kia Corporation, Seoul (KR); BASE AND POWER CITY Corp., Seoul (KR)

(72) Inventors: Donguk Lee, Seoul (KR); Sungsu Park, Seoul (KR)

(73) Assignees: Hyundai Motor Company, Seoul (KR); Kia Corporation, Seoul (KR); BASE AND POWER CITY Corp., Seoul (KR)

( * ) Notice: Subject to any disclaimer, the term of this patent is extended or adjusted under 35 U.S.C. 154(b) by 198 days.

(21) Appl. No.: 18/760,447

(22) Filed: Jul. 1, 2024

(65) Prior Publication Data

US 2025/0146290 A1 May 8, 2025

(30) Foreign Application Priority Data

Nov. 7, 2023 (KR) ..... 10-2023-0152887

(51) Int. Cl.
*E04F 11/02* (2006.01)

(52) U.S. Cl.
CPC ..... *E04F 11/02* (2013.01); *E04F 2011/0203* (2013.01)

(58) Field of Classification Search
CPC . E04F 11/02; E04F 11/025; E04F 2011/0203; E04F 11/04; F16H 19/04
See application file for complete search history.

(56) References Cited

U.S. PATENT DOCUMENTS

| | | | |
|---|---|---|---|
| 9,997,033 | B2 | 6/2018 | Hyde et al. |
| 2010/0108443 | A1 | 5/2010 | Uche |

FOREIGN PATENT DOCUMENTS

| | | | | | |
|---|---|---|---|---|---|
| CN | 109113282 | A | * | 1/2019 | ..... E04F 11/02 |
| CN | 109372202 | A | * | 2/2019 | ..... E04F 11/1041 |
| CN | 110206243 | A | * | 9/2019 | ..... E04F 11/1041 |
| CN | 114000667 | A | * | 2/2022 | ..... E04F 11/09 |
| KR | 20190002457 | U | | 10/2019 | |
| KR | 102066528 | B1 | * | 1/2020 | ..... E04F 11/04 |
| KR | 20210055413 | A | | 5/2021 | |
| KR | 20220009323 | A | | 1/2022 | |
| KR | 20220122961 | A | | 9/2022 | |
| KR | 20220139528 | A | | 10/2022 | |

* cited by examiner

*Primary Examiner* — Babajide A Demuren
(74) *Attorney, Agent, or Firm* — Slater Matsil, LLP

(57) ABSTRACT

A module for a staircase can include a case configured to be installed on a front surface of a stair, a driving part located in an interior of the case, and a guide part driven in an upward/downward direction by the driving part to be located in the interior of the case or to be exposed to an outside of the case.

20 Claims, 6 Drawing Sheets

MODULE FOR STAIRCASE AND STAIRCASE SYSTEM INCLUDING SAME

CROSS-REFERENCE TO RELATED APPLICATIONS

This application claims the benefit of Korean Patent Application No. 10-2023-0152887, filed on Nov. 7, 2023, which application is hereby incorporated herein by reference.

TECHNICAL FIELD

The present disclosure relates to a module for a staircase.

BACKGROUND

A staircase including a plurality of stairs is very easy to overcome for humans, but not easy for robots that move by using wheels or robots having legs. The robot may slip, drop, or fall while climbing a staircase, and when a person is using the same staircase, there is a risk of such a robot accident leading to a human accident.

Accordingly, for a person and a robot to share and use the same staircase, a way for preventing the robot from falling and to ensure that the person and robot are appropriately wary of each other is necessary.

SUMMARY

The present disclosure relates to a module for a staircase, and a staircase system including same.

Some embodiments of the present disclosure can solve the above-mentioned problems occurring in the prior art while advantages achieved by the prior art are maintained intact.

An embodiment of the present disclosure can provide a module for a staircase that is configured such that a robot and a person share a staircase safely, and a staircase system including the same.

Technical problems to be solved by some embodiments of the present disclosure are not necessarily limited to the aforementioned problems, and solutions using an embodiment of the present disclosure for other technical problems not mentioned herein can be clearly understood from the following description by those skilled in the art to which the present disclosure pertains.

According to an embodiment of the present disclosure, a module for a staircase includes a case installed on a front surface of a stair, a driving part located in an interior of the case, and a guide part driven in an upward/downward direction by the driving part to be located in the interior of the case or be exposed to an outside of the case.

According to an embodiment of the present disclosure, a staircase system includes a plurality of modules for a staircase installed on front surfaces of a plurality of stairs of a staircase, respectively, and a processor electrically connected to the plurality of modules for a staircase, each of the modules for a staircase includes a case installed on the front surface of the corresponding stair, a guide part that is located in an interior of the case or be exposed to an outside of the case, and an information acquisition part that acquires whether an object is located around the case, and the processor operates the guide part based on information acquired by the information acquisition part to prevent an object located on the plurality of stairs from slipping.

BRIEF DESCRIPTION OF THE DRAWINGS

The above and other features and advantages of the present disclosure can be more apparent from the following detailed description taken in conjunction with the accompanying drawings, in which.

DETAILED DESCRIPTION OF ILLUSTRATIVE EMBODIMENTS

Figure 1:
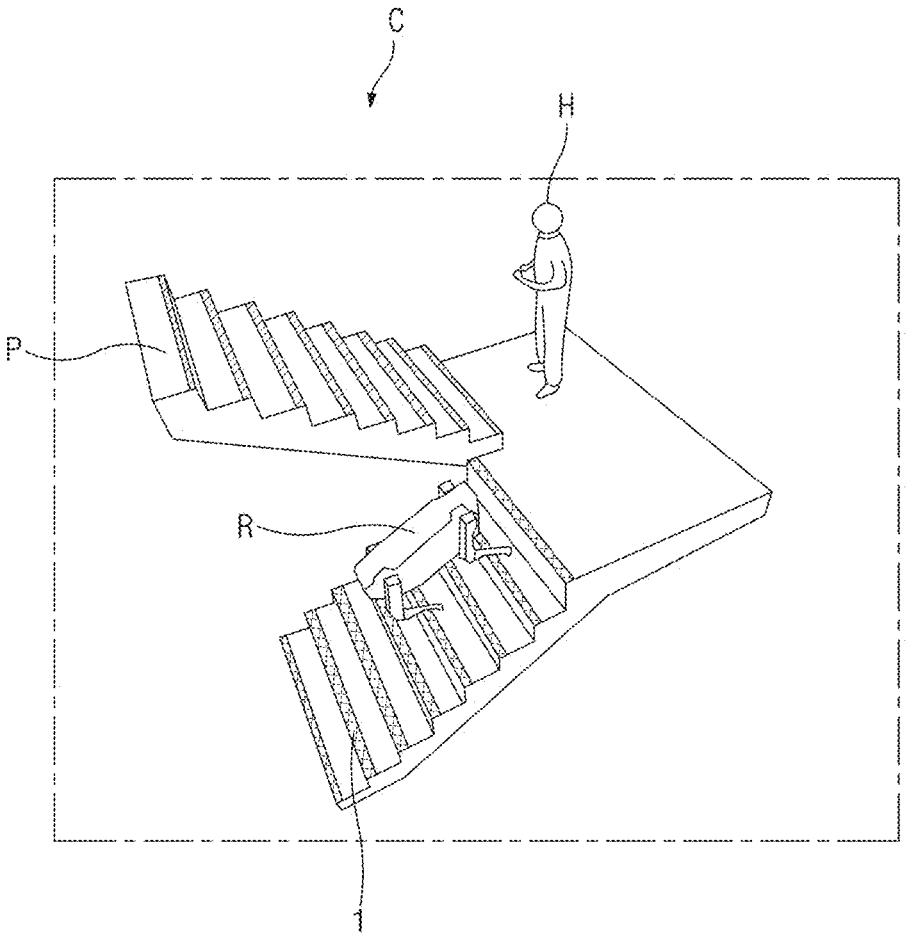
FIG. 1 is a perspective view of a staircase system including a module for a staircase according to an embodiment of the present disclosure.

Hereinafter, some example embodiments of the present disclosure will be described in detail with reference to the accompanying drawings. In adding reference numerals to the components of the drawings, it can be noted that same components can be denoted by same reference numerals even when they are drawn in different drawings. Furthermore, in describing the example embodiments of the present disclosure, when it is determined that a detailed description of related known configurations and functions may hinder understanding of the example embodiments of the present disclosure, a detailed description thereof can be omitted.

In the present disclosure, terms such as "first", "second", "A", "B", "(a)", and "(b)" may be used. Such terms can be simply for distinguishing the components, and the essence, the sequence, and the order of the corresponding components are not necessarily limited by such terms. When it is described that a certain component is "connected to", "coupled to" or "electrically connected to" a second component, it can be understood that the component may be directly connected or electrically connected to the second component, but a third component may be "connected" or "electrically connected" between the components.

Figure 2:
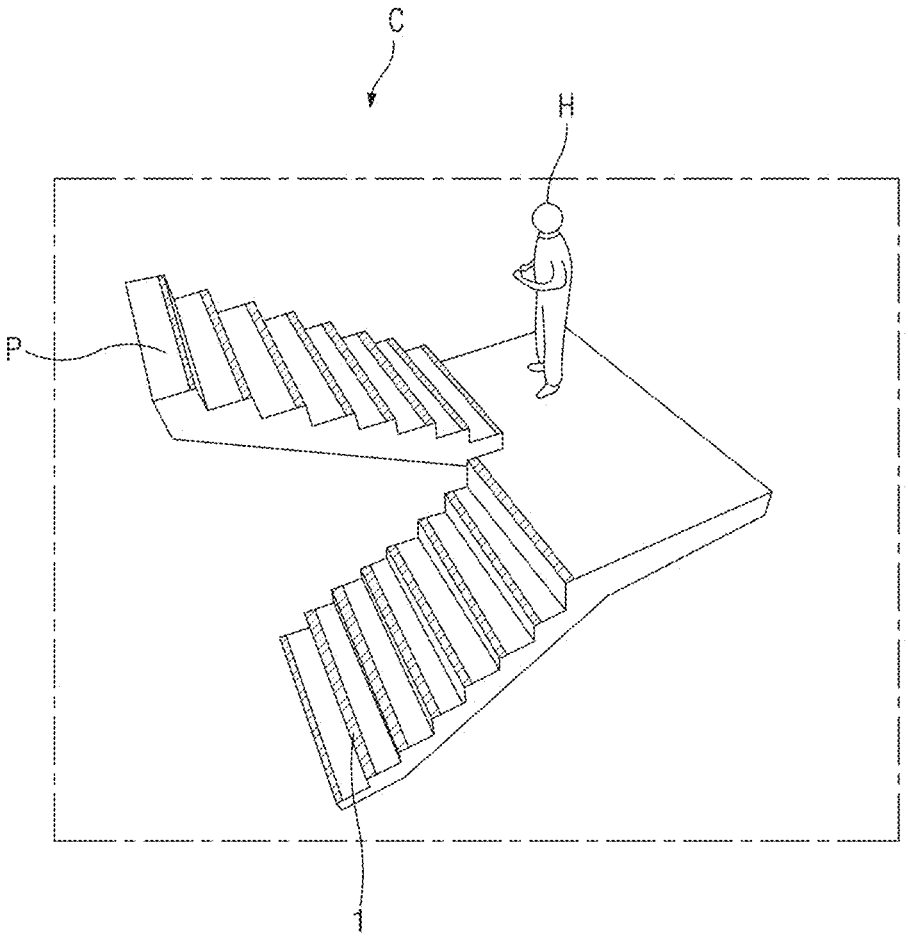
FIG. 2 is a perspective view of a staircase system including a module for a staircase according to an embodiment of the present disclosure.

FIG. 1 is a perspective view illustrating a staircase system including a module 1 for a staircase together with a staircase "C" according to an embodiment of the present disclosure. FIG. 2 is a perspective view illustrating a state, in which a robot "R" has not entered the staircase "C" in FIG. 1.

In the specification of the present disclosure, forward, rearward, leftward, rightward, upward, and downward directions can be referred to for convenience of description, and these directions may be determined with respect to a direction, in which the staircase "C" can be positioned, with an assumption that the staircase "C" can include a plurality of stairs "P" that can extend along a leftward/rightward direction and can be inclined downward with respect to the forward direction. The forward/rearward direction, the leftward/rightward direction, and the upward/downward direction may be directions that are perpendicular to each other.

In some embodiments, the staircase system can include the module 1 for a staircase and a processor, any combination of or all of which may be in plural or may include plural components thereof. The module 1 for a staircase can be coupled to the staircase "C" having the plurality of stairs "P", and the processor can be electrically connected to a plurality of modules 1 for a staircase. In some embodiments of the present disclosure, the staircase "C" may refer to a set of a plurality of stepped stairs "P". The staircase "C" may be installed in a space for the staircase "C" or an open space.

A staircase system according to an embodiment of the present disclosure may include the processor. The processor may be electrically connected to the components of the staircase system. A processor can be a component that includes elements capable of logical operations for performing control instructions, and may include a central processing unit (CPU). The processor can be connected to various components of the module 1 for a staircase according to an embodiment of the present disclosure, may transmit signals according to control instructions to the components, and may be connected to various sensors or acquisition parts to receive acquired information in a form of signals. Because the processor may be electrically connected to the components, it may be connected with a conductive wire or be connected wirelessly to communicate with each other.

A staircase system according to an embodiment of the present disclosure may include a wireless communication module. The wireless communication module may be electrically connected to the processor and may communicate wirelessly with the communication module of the module 1 for a staircase.

A staircase system can further include a storage medium, and control instructions performed by the processor may be stored and utilized in the storage medium, any combination of or all of which may be in plural or may include plural components thereof. The storage medium may be a device, such as a hard disk drive (HDD), a solid state drive (SSD), a server, a volatile medium, or a non-volatile medium, but the type thereof is not limited thereto, for example. In addition, data needed by the processor to perform tasks may be stored in the storage medium.

The processor may receive information acquired by an information acquisition part 60 included in the module 1 for a staircase, and may be set to control a lighting part 40 included in the module 1 for a staircase by recognizing whether an object is located on and around the plurality of stairs "P" based on the corresponding information. The processor may be set to operate a guide part 30 based on the information acquired by the information acquisition part 60 to prevent an object located on the plurality of stairs "P" from slipping or to improve traction and/or engagement of an object with a given stair. The object may be the robot "R" or a person "H" who uses the staircase "C", for example.

When the object is located on the plurality of stairs "P" or around the plurality of stairs "P", the lighting part 40 may provide a visual notification to the robot "R" or the person "H" who is intended to use the staircase "C" by changing a light emission state of the lighting part 40 of the module 1 for a staircase at a periphery, at which the object is located. The light emission state may include at least one of a color emitted by the lighting part 40, a blinking cycle, an emission location with respect to the leftward/rightward direction, an emission time period, or a combination thereof.

For example, in normal times, the lighting part 40 can emit light in a same color as in FIG. 2, but when the robot "R" is located on the plurality of stairs "P" as illustrated in FIG. 1, the color emitted by the lighting part 40 of the module 1 for a staircase nearby can be changed whereby the robot "R" or the person "H" easily identify that the object is located on the staircase "C". It may be easily identified whether the object is located on the staircase "C", and thus, the robot "R" or the person "H" who has identified this may safely share the staircase "C", for example, by using the staircase "C" after the object has passed.

When it is identified that the object is slipping while being located on the plurality of stairs "P", the guide part 30 of the module 1 for a staircase located on a lower side of the object in the vicinity, in which the object is located, may protrude upward. Accordingly, the object may no longer slip or fall by being stopped by the protruding guide part 30, and the slipping of the object may be prevented or hindered from leading to an additional accident. When a sudden downward change in the location information of the object acquired by the information acquisition part 60 by using an optical sensor or a pressure sensor is identified, the processor may determine that the object has slipped or fallen.

The plurality of modules 1 for a staircase may be installed on front surfaces of the plurality of stairs "P" of the staircase "C", respectively. The plurality of modules 1 for a staircase may be coupled to the staircase "C" after being inserted into a groove that is recessed downward from a rearmost end of the upper surfaces of the plurality of stairs "P". These grooves may extend in leftward/rightward direction. The module 1 for a staircase may be inserted into the groove and may be configured to protrude upward from the groove. In a state, in which the guide part 30 does not protrude, an upper end of the module 1 for a staircase may be located at a same height as that of the upper surface of the stair "P" one step above the stair "P", on which the groove is formed. The module 1 for a staircase may also extend in the leftward/rightward direction, and may be formed in a plate shape that is perpendicular to the forward/rearward direction.

In an embodiment of the present disclosure, the plurality of modules 1 for a staircase may be inserted into grooves formed at regular intervals on an inclined path rather than the staircase "C" to perform a same or similar operation. When the module 1 for a staircase is used on the inclined path, an upper end of the module 1 for a staircase may be formed side by side with the inclined path not to interfere with movement of an object along the inclined path while the guide part 30 is lowered to the lowermost point.

Figure 3:
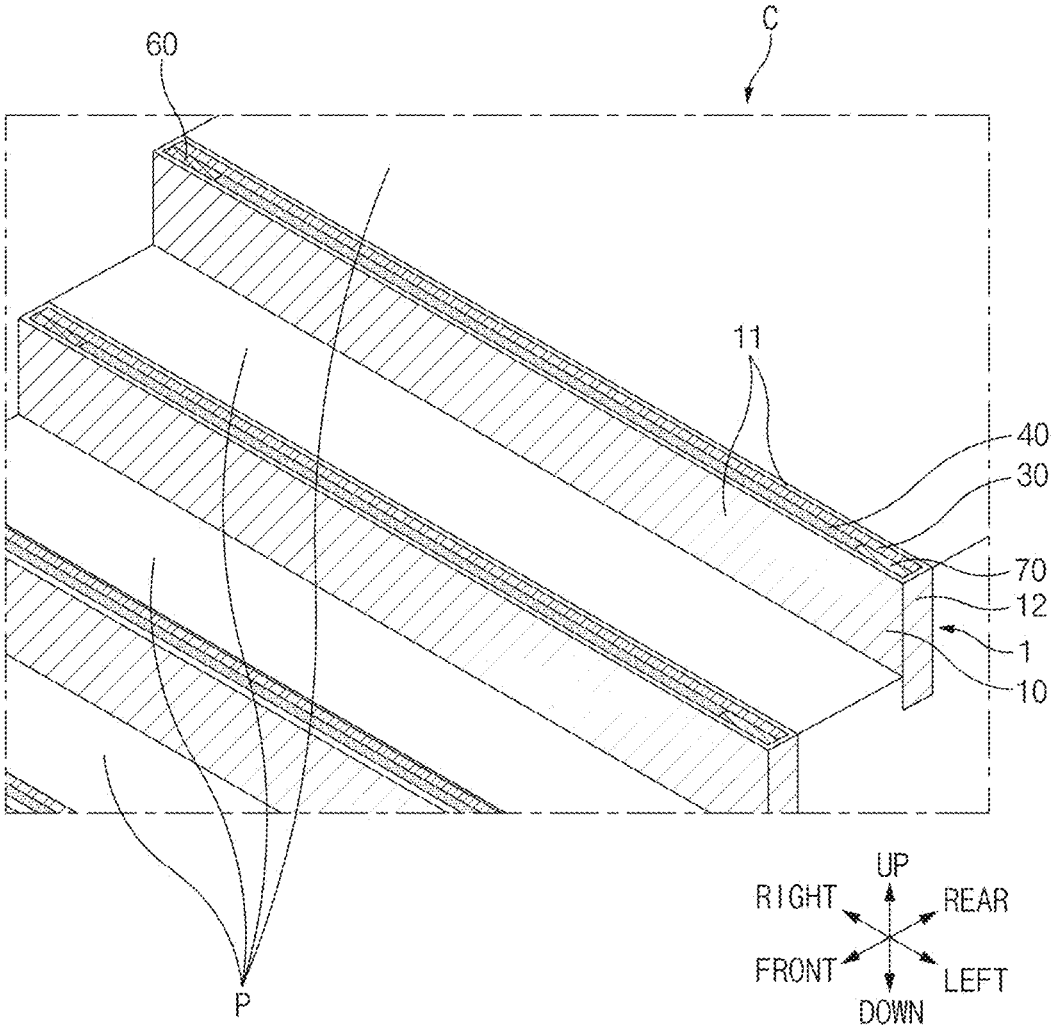
FIG. 3 is a perspective view of a staircase system conceptually illustrating a state in which a module for a staircase is installed in the staircase according to an embodiment of the present disclosure.
Figure 4:
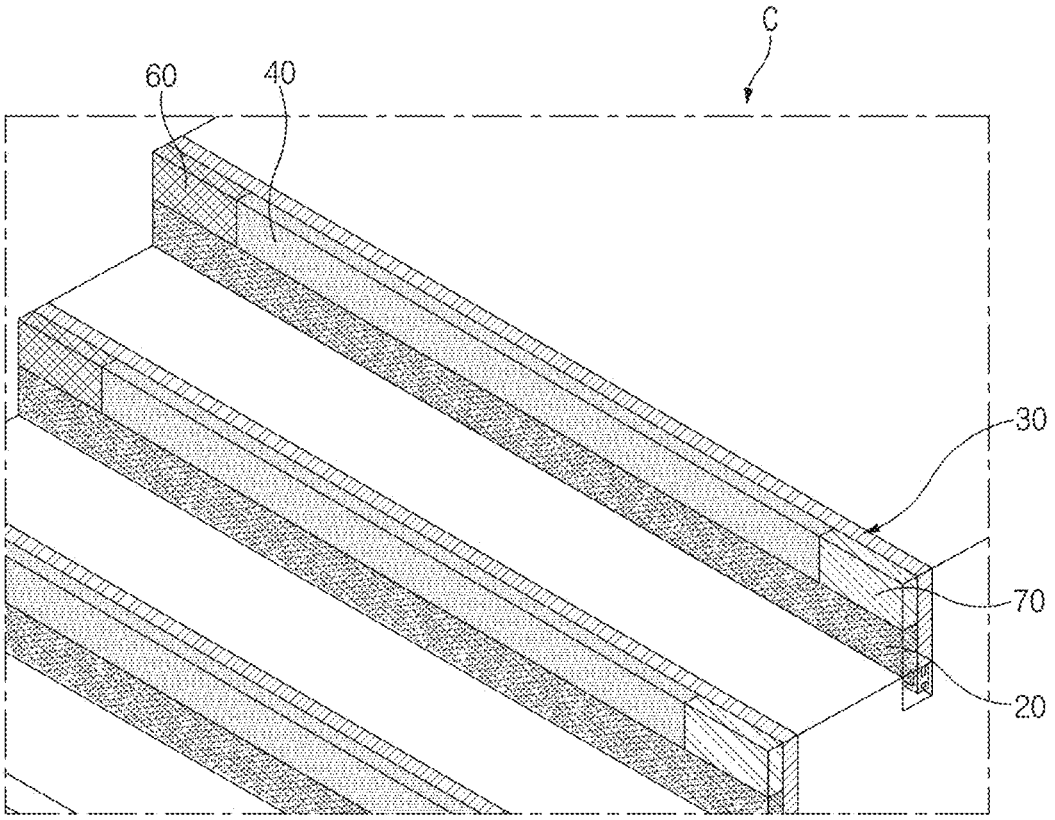
FIG. 4 is a cut-away perspective view of the staircase system of FIG. 3, in which a case is removed.
Figure 5:
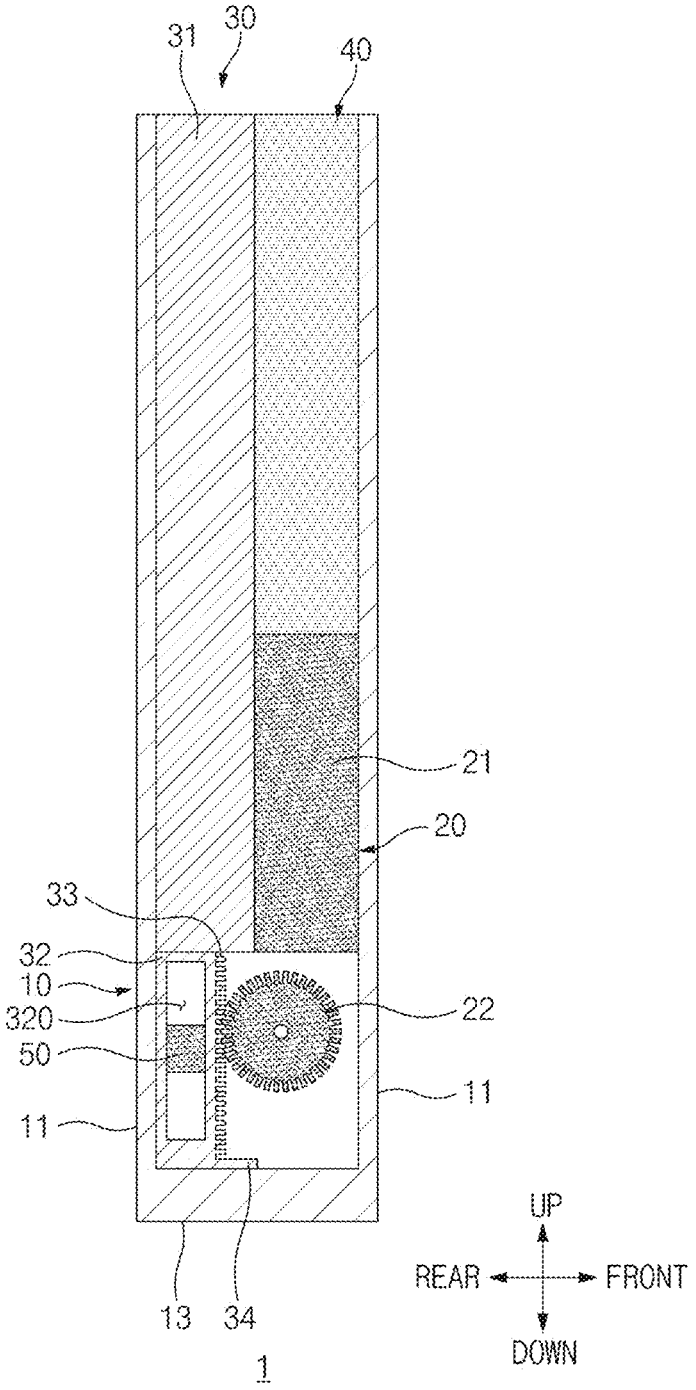
FIG. 5 is a cross-section view of a module conceptually illustrating a state in which a module for a staircase, according to an embodiment of the present disclosure, is cut by a plane that is perpendicular to a leftward/rightward direction.
Figure 6:
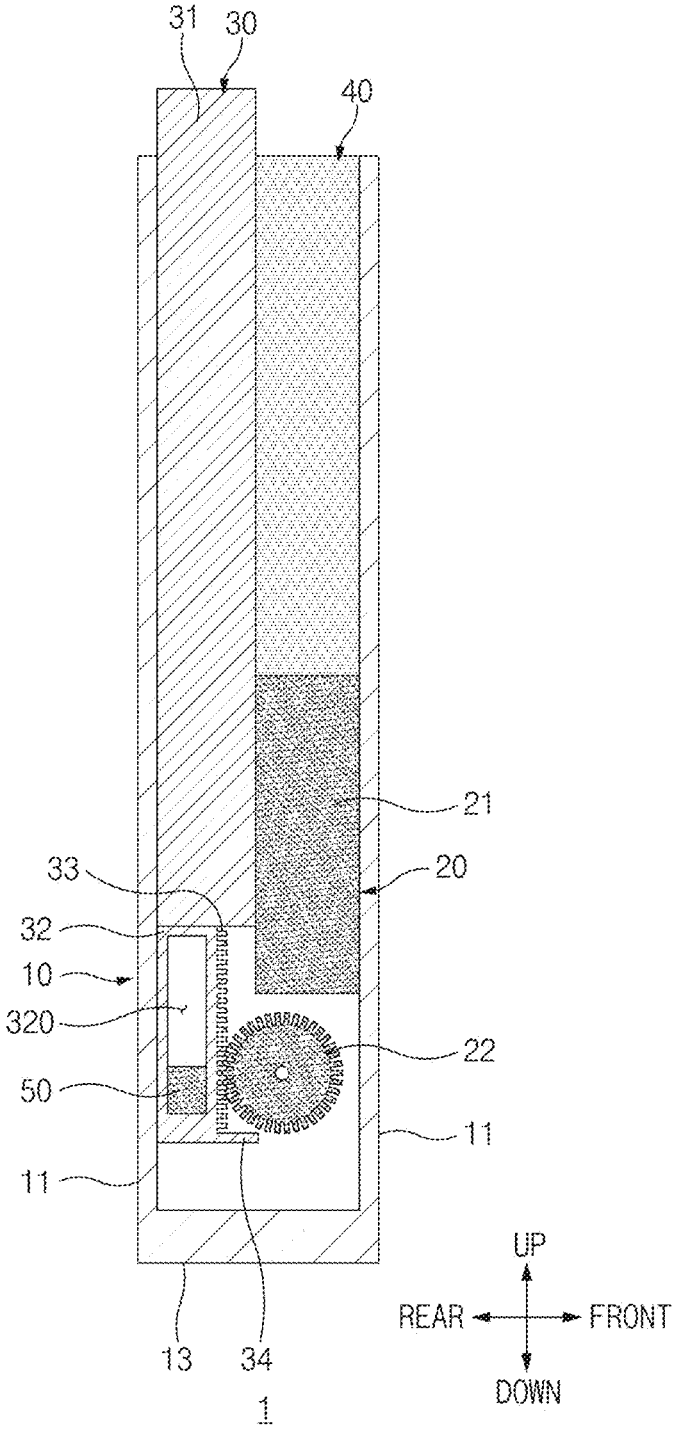
FIG. 6 is a cross-section view of a module illustrating a state in which a guide part protrudes upward in the module for a staircase of FIG. 5, according to an embodiment of the present disclosure.

FIG. 3 is a perspective view conceptually illustrating a state, in which the module 1 for a staircase is installed on the staircase "C" according to an embodiment of the present disclosure. FIG. 4 is a cut-away perspective view of FIG. 3, in which a case 10 from FIG. 3 is removed for illustration purposes. FIG. 5 is a cross-section view of a module 1 conceptually illustrating a state, in which the module 1 for a staircase according to an embodiment of the present disclosure is cut by a plane that is perpendicular to the leftward/rightward direction. FIG. 6 is a cross-section view of a module 1, according to an embodiment of the present disclosure, illustrating the guide part 30 that protrudes upward in the module 1.

The module 1 for a staircase according to an embodiment of the present disclosure may include the case 10, a driving part 20, and the guide part 30.

In some embodiments, the case 10 can be installed on the front surface of the stair "P". An upper end of the case 10 may be located at the same height as that of the upper surface of the stair "P" one step above the stair "P", in which the groove is formed. The upper end of the case 10 may be opened in an upward/downward direction to define an entrance/exit opening, through which the guide part 30 may pass.

The case 10 may include a pair of front and rear plates 11 that are perpendicular to the forward/rearward direction and are spaced apart from each other along the forward/rearward direction, and a lower plate 13 that connects lower ends of the front and rear plates 11. The entrance/exit opening may be formed between upper ends of the pair of front and rear plates 11. The case 10 may include left and right plates 12 that are perpendicular to the leftward/rightward direction and are spaced apart from each other along the leftward/rightward direction, and connect left and right ends of the pair of front and rear plates 11. That is, the case 10 may be formed in a form of an open-topped rectangular box. However, a shape of the case 10 is not necessarily limited thereto.

The driving part 20 is located in an interior of the case 10. The driving part 20 may include a power source 21 that is configured to generate power, and a pinion part 22 that receives the power from the power source 21 to be rotated. The power source 21 may be a motor or actuator that receives electric power and generates power, but the type thereof is not limited thereto. The pinion part 22 may be connected to a shaft that outputs the power of the power source 21. The pinion part 22 may receive the power to be rotated. Gear teeth that may be enmeshed with other gears may be formed on an outer surface of the pinion part 22.

A driving part 20 may be coupled to a front surface of an inner surface of the case 10. The driving part 20 may be located on a lower side of the interior of the case 10. A pinion part 22 may be located on a lower side of a power source 21. However, the location of the driving part 20 is not necessarily limited thereto.

The guide part 30 may be driven in the upward/downward direction by the driving part 20, and may be located in the interior of the case 10 (e.g., in a retracted position or retracted state as illustrated in FIG. 5) or may be exposed to an outside of the case 10 (e.g., in an extended position or a protruding state as illustrated in FIG. 6). Accordingly, an upper end of the guide part 30 may be located on a lower side of an upper end of the case 10 while the guide part 30 is lowered most, and the upper end of the guide part 30 may be located on an upper side of the upper end of the case 10 while the guide part 30 is raised most. The guide part 30 may be located on a rear side of the driving part 20, but the location thereof is not necessarily limited thereto. For example, the positions of the lighting part 40 and the guide part 30 shown in FIG. 5 may be switched.

The guide part 30 may include a plate-shaped guide plate 31 that is perpendicular to the forward/rearward direction. The guide plate 31 may prevent objects from sliding while being elevated or extended out of the case 10. An upper end of the guide plate 31 may be located on an upper side of the upper end of the case 10 when the guide plate 31 is raised most, as illustrated in FIG. 6 for example.

The guide part 30 may include a rack part 33 that is coupled to a lower end of the guide plate 31 and is enmeshed with the pinion part 22 to be moved in the upward/downward direction through rotation of the pinion part 22. That is, the guide part 30 and the driving part 20 can constitute a rack-pinion structure, and thus a rotational driving force of the power source 21 on the pinion part 22 may be converted into a driving force for linear movement of the rack part 33 in the upward/downward direction. The rack part 33 may include a plurality of gear teeth that are arranged along the upward/downward direction and that face the pinion part 22. The rack part 33 may be formed to face a front side from a rear side of the pinion part 22.

The guide part 30 may include a vertical guide 32. The vertical guide 32 may have a shape that extends downward from the lower end of the guide plate 31 and may be coupled to the lower end of the guide plate 31. The rack part 33 may be formed on a front surface of the vertical guide 32. The vertical guide 32 may be recessed or penetrated in the leftward/rightward direction and be opened to form a pin insertion part 320 that extends in the upward/downward direction. A direction, in which this pin insertion part 320 is recessed, may be a direction that is perpendicular to the upward/downward direction rather than the leftward/rightward direction.

The module 1 for a staircase according to an embodiment of the present disclosure may include a guide pin 50. The guide pin 50 may be coupled to an inner surface of the case 10 in the interior of the case 10, and may extend along one direction that is perpendicular to the upward/downward direction. The one direction may be the leftward/rightward direction. The guide pin 50 may be inserted into the pin insertion part 320 formed on the vertical guide 32 to form a slider mechanism. Because the guide pin 50 is fixed when the guide plate 31 and the vertical guide 32 are elevated with respect to the case 10, the guide pin 50 may guide and/or limit movement of the vertical guide 32 such that the vertical guide 32 is elevated while not deviating from a specific route, a height of which corresponds to a height of the pin insertion part 320 in the upward/downward direction.

The guide part 30 may include a limit part 34. The limit part 34 may protrude forward from a lower end of the rack part 33 to be stopped by the pinion part 22 when the rack part 33 is raised. Accordingly, while the guide part 30 is rising overall, the rising can be limited by the limit part 34 after the limit part 34 is stopped by the pinion part 22.

Referring to FIGS. 3 and 4, the module 1 for a staircase according to an embodiment of the present disclosure may include an information acquisition part 60. The information acquisition part 60 may acquire whether an object is present around the case 10. The information acquisition part 60 may be electrically connected to the processor and may transmit the acquired information to the processor. The information acquisition part 60 may be electrically connected to a controller provided in the module 1 for a staircase to allow processing of information similarly to the processor to transmit the acquired information.

The information acquisition part 60 may include a pressure sensor that is located on upper surfaces of the plurality of stairs "P" to identify whether the object is located on the plurality of stairs "P". When an area, in which a portion of the pressure sensor is located, is pressed by the object, the pressure sensor can acquire a change in pressure. The methods for acquiring pressure by a pressure sensor can include a strain gauge method and/or a capacitance method, but the methods that may be used are not necessarily limited thereto.

The information acquisition part 60 may include an optical sensor that is configured to identify a location of an object around the plurality of stairs "P" through emission and reception of light. The optical sensor may include an infrared sensor and/or an ultraviolet sensor, but the type of the optical sensor that may be used is not necessarily limited thereto.

The module 1 for a staircase according to an embodiment of the present disclosure may include a lighting part 40. The lighting part 40 may emit light based on the information acquired by the information acquisition part 60. The lighting part 40 may be electrically connected to a processor or electrically connected to the above-described controller to receive control signals.

The lighting part 40 may be an LED light that may receive electric power and emit light but the type of the device that may emit light that may be used for the lighting part 40 is not necessarily limited thereto.

The lighting part 40 may be located in the case 10. The lighting part 40 may be located on an upper side of the driving part 20. The lighting part 40 may be coupled to the inner surface of the case 10 on a front side of the guide part 30, but the location thereof is not necessarily limited thereto. The lighting part 40 may be exposed to an outside through the entrance/exit opening so that the emitted light may be seen from the outside of the case 10. The lighting part 40 may have a shape that extends along the leftward/rightward direction when viewed along the upward/downward direction.

The information acquisition part 60 may be positioned on one side of the lighting part 40 in the leftward/rightward direction. A speaker part 70 may be located on an opposite side of the lighting part 40 in the leftward/rightward direction. However, a state, in which the information acquisition part 60, the lighting part 40, and the speaker part 70 are positioned and configured is not necessarily limited thereto.

The module 1 for a staircase according to an embodiment of the present disclosure may include a speaker part 70. The speaker part 70 may generate sound based on the information acquired by the information acquisition part 60. The speaker part 70 may be electrically connected to the processor or may be electrically connected to the above-described controller to receive control signals. The speaker part 70 may inform the robot "R" or person "H" who tries to use the staircase "C" whether there is an object who already occupies the staircase "C", with an auditory system other than lighting.

Accordingly, by implementing an embodiment of the present disclosure, a person and a robot may share a staircase safely.

By implementing an embodiment of the present disclosure, if the robot drops, the robot may be prevented from falling further down the stairs.

In the above description, just because all the components constituting the example embodiments of the present disclosure are described as being combined or operating in combination, the present disclosure is not necessarily limited by these example embodiments. That is, within the scope of the present disclosure, components may operate in selective combination of one or more for a given embodiment. In addition, terms such as "include," "comprise," or "have" described above can be interpreted such that the corresponding component may be present, and thus do not exclude other components unless specifically stated to the contrary, and rather, it can be interpreted as being able to include other components. Unless defined differently, terms including technical or scientific terms can have a same meanings as those generally understood by an ordinary person in the art, to which the present disclosure pertains. Terms, such as terms defined in dictionaries, which are generally used, can be construed to coincide with a contextual meaning of the related technologies.

The above description is a simple example description of the technical spirits of the present disclosure, and an ordinary person in the art, to which the present disclosure pertains, may make various corrections and modifications without departing from the spirit of the present disclosure. Therefore, the example embodiments disclosed in the present disclosure are not necessarily for limiting the technical spirits of the present disclosure but for describing them, and the scope of the technical spirits of the present disclosure is not necessarily limited by the example embodiments described herein. The protection scope of the present disclosure can be construed by the following claims, and the technical spirits in the equivalent range can be construed as being included in the scope of the present disclosure.

What is claimed is:

1. A staircase module, comprising:

a case configured to be installed on a front surface of a stair;

a driving part located in an interior of the case;

an information acquisition part configured to acquire whether an object is located at or adjacent to the case; and a guide part configured to be driven in an upward/downward direction by the driving part relative to the case between a retracted state and a protruding state, wherein the guide part is located in the interior of the case at the retracted state, and wherein an extension portion of the guide part protrudes outside of the case at the protruding state.

2. The module of claim 1, wherein the case defines an entrance/exit opening, an upper end of which is opened in the upward/downward direction and configured such that the extension portion of the guide part passes therethrough at the protruding state.

3. The module of claim 1, wherein the driving part includes a power source configured to generate power, and a pinion part configured to receive the power from the power source to be rotated, and wherein the guide part includes a plate-shaped guide plate extending along the upward/downward direction, and a rack part coupled to a lower end of the guide plate, the rack part being enmeshed with the pinion part to be moved in the upward/downward direction through rotation of the pinion part.

4. The module of claim 3, wherein the guide part further includes a limit part protruding from a lower end of the rack part, the limit part being configured to be stopped by the pinion part in response to the rack part being raised to an upper threshold.

5. The module of claim 1, further comprising a guide pin fixedly coupled to the case in the interior of the case, and extending along one direction being perpendicular to the upward/downward direction, wherein the guide part includes a plate-shaped guide plate extending along the upward/downward direction, the guide plate having a vertical slot therein, wherein the guide pin is inserted into the vertical slot.

6. The module of claim 1, further comprising a lighting part configured to emit light based on information acquired by the information acquisition part.

7. The module of claim 1, further comprising a speaker part configured to generate sound based on information acquired by the information acquisition part.

8. A staircase system comprising modules for a staircase, each of the modules being installed on a front surface of each stair of the staircase, and wherein each of the modules comprises:

a case installed on the front surface;

a guide part located at least partially in an interior of the case, the guide part being configured to protrude at least partially outside of the case;

an information acquisition part configured to acquire whether an object is located at or adjacent to the case;

one or more processors; and a storage medium storing computer-readable instructions that, when executed by the one or more processors, enable the one or more processors to operate movement of the guide part based on information acquired by the information acquisition part to assist the object relating to slipping on the staircase by protruding the guide part from the case.

9. The staircase system of claim 8, wherein the information acquisition part comprises a pressure sensor located at an upper surface of the stair and configured to identify whether the object is located on the stair.

10. The staircase system of claim 9, wherein each of the modules further comprises a lighting part configured to emit light;

wherein the information acquisition part further includes an optical sensor configured to identify whether the object is located around the stair; and wherein the instructions further enable the one or more processors to control the lighting part by recognizing whether the object is located on the stair and around the stair based on the information acquired by the information acquisition part.

11. A staircase module, comprising:

a case configured to be installed on a front surface of a stair;

a driving part located in an interior of the case; and a guide part configured to be driven in an upward/downward direction by the driving part relative to the case between a retracted state and a protruding state, wherein the guide part is located in the interior of the case at the retracted state, and wherein an extension portion of the guide part protrudes outside of the case at the protruding state;

an information acquisition part configured to acquire whether an object is located at or adjacent to the case;

one or more processors; and a storage medium storing computer-readable instructions that, when executed by the one or more processors, enable the one or more processors to control movement of the guide part between the retracted state and the protruding state based on information acquired by the information acquisition part.

12. The module of claim 11, further comprising a lighting part configured to emit light.

13. The module of claim 12, wherein the instructions further enable the one or more processors to control the lighting part based on information acquired by the information acquisition part.

14. The module of claim 11, further comprising a speaker part configured to generate sound.

15. The module of claim 14, wherein the instructions further enable the one or more processors to send audio signals for audio notifications to the speaker part based on information acquired by the information acquisition part.

16. The module of claim 11, wherein the driving part includes a power source configured to generate power, and a pinion part configured to receive the power from the power source to be rotated, and wherein the guide part includes a plate-shaped guide plate extending along the upward/downward direction, and a rack part coupled to a lower end of the guide plate, the rack part being enmeshed with the pinion part to be moved in the upward/downward direction through rotation of the pinion part.

17. The module of claim 16, wherein the instructions further enable the one or more processors to control the driving part based on information acquired by the information acquisition part.

18. The module of claim 16, further comprising a guide pin fixedly coupled to the case in the interior of the case, and extending along one direction being perpendicular to the upward/downward direction, wherein the guide part includes a plate-shaped guide plate extending along the upward/downward direction, the guide plate having a vertical slot therein, wherein the guide pin is inserted into the vertical slot.

19. The staircase system of claim 8, wherein each of the modules further comprises a speaker part configured to generate sound based on information acquired by the information acquisition part.

20. The staircase system of claim 8, wherein the guide part of each module includes a plate-shaped guide plate extending along an upward/downward direction, and a rack part enmeshed with a pinion part of a driving part to move the guide part upward/downward.

* * * * *